US005324363A

United States Patent [19]

Robbins et al.

[11] Patent Number: 5,324,363

[45] Date of Patent: Jun. 28, 1994

[54] METHOD FOR CARBONACEOUS DEPOSIT REMOVAL AND FOR REDUCING ENGINE OCTANE REQUIREMENT USING AN AQUEOUS BASE

[75] Inventors: John L. Robbins, Stockton; Robert S. Lunt, North Plainfield, both of N.J.

[73] Assignee: Exxon Research and Engineering Company, Florham Park, N.J.

[21] Appl. No.: 914,730

[22] Filed: Jul. 20, 1992

[51] Int. Cl.[5] ..... B08B 3/10

[52] U.S. Cl. ..... 134/39; 134/20; 134/22.16; 134/22.19

[58] Field of Search ..... 134/20, 39, 22.16, 22.19

[56] References Cited

U.S. PATENT DOCUMENTS

| | | | |
|---|---|---|---|
| 1,787,789 | 1/1931 | Lovell et al. | 134/20 |
| 1,820,395 | 8/1931 | Lovell et al. | 134/20 |
| 1,924,722 | 8/1933 | Lovell et al. | 134/20 |
| 2,718,480 | 9/1955 | Lauer | 134/2 |
| 2,956,910 | 10/1960 | Giammaria | 134/22.19 |
| 3,082,128 | 3/1963 | Willis | 148/6.15 |
| 3,261,723 | 7/1966 | Willis | 148/6.15 |
| 4,197,140 | 4/1980 | Swan | 134/20 |
| 4,247,301 | 1/1981 | Honnen | 44/63 |
| 4,302,215 | 11/1981 | Lewis | 44/71 |
| 4,322,305 | 3/1982 | Lewis | 252/51 |
| 4,357,148 | 11/1982 | Graiff | 44/62 |
| 4,666,529 | 5/1987 | Graiff | 134/20 |
| 4,787,916 | 11/1988 | Feldman | 44/92 |
| 4,865,621 | 9/1989 | Sung | 44/62 |
| 4,877,416 | 10/1989 | Campbell | 44/62 |
| 4,906,389 | 3/1990 | Brownawell et al. | 252/25 |
| 4,975,096 | 12/1990 | Buckley, III | 44/71 |

FOREIGN PATENT DOCUMENTS

| | | | |
|---|---|---|---|
| 0320279A2 | 12/1988 | European Pat. Off. | 133/4 |
| 2106734 | 9/1970 | France . | |
| 9107578 | 5/1991 | PCT Int'l Appl. . | |

OTHER PUBLICATIONS

*Introduction to Organic Chemistry,* Streitwieser and Heathcock, MacMillan, 2nd ed., 1981, pp. 754–755.

Patent Abstracts of Japan—JP 62266395, Nov. 19, 1987, Tanji et al., "Method of Removing Adhesions on Thermal Conducting Surface of Waste Heat Recovery Device".

J. W. Orelup and O. I. Lee, "Factors Influencing Carbon Formation in Automobile Engines", Jul., 1925, pp. 731–735, *Industrial and Enginnering Chemistry.*

*Primary Examiner*—R. Bruce Breneman
*Assistant Examiner*—Thomas G. Dunn, Jr.
*Attorney, Agent, or Firm*—Estelle C. Bakun

[57] ABSTRACT

Accumulation of carbonaceous deposits on the combustion chamber surfaces of internal combustion engines is responsible for increased fuel octane requirement to prevent knock. Treatment of these carbonaceous deposits with weak bases, such as aqueous ethylenediamine, aids in their removal and thereby reduces the octane requirement of an internal combustion engine. The method is also applicable for removal of carbonaceous deposits from metal surfaces generally.

9 Claims, No Drawings

METHOD FOR CARBONACEOUS DEPOSIT REMOVAL AND FOR REDUCING ENGINE OCTANE REQUIREMENT USING AN AQUEOUS BASE

FIELD OF THE INVENTION

Spark-ignited internal combustion engines exhibit a phenomenon known as octane requirement increase (ORI) caused by the buildup of carbonaceous residues on the combustion chamber surface. Physical removal of such deposits by scraping, sanding, etc., reduces the engine octane requirement, but these procedures require substantial disassembly of the engine. As the internal combustion engine is operated over time, it will require an increased octane fuel to prevent engine knock. The octane requirement eventually stabilizes at a number approximately 4–10 octane numbers higher than that originally required.

Applicants have discovered a process for removing carbonaceous deposits from metal surfaces, especially spark-ignited and compression-ignited internal combustion engines, by utilizing aqueous bases. The invention is effective in decreasing the engine octane requirement of spark-ignited internal combustion engines and can be carried out without substantial disassembly of the engines.

SUMMARY OF THE INVENTION

The present invention is a process for removing carbonaceous deposits from metal surfaces, especially spark-ignited or compression ignited internal combustion engines, by treatment with aqueous solutions of organic or inorganic bases. The invention is especially useful in reducing the octane requirement of spark-ignited internal combustion engines, by treatment in situ with such solutions, without requiring substantial disassembly of the engine. The process comprises:

(a) contacting the metal surface with an aqueous organic or aqueous inorganic base;

(b) soaking said metal surface in said aqueous organic or aqueous inorganic base for a time and at a temperature sufficient to effect carbonaceous deposit removal;

(c) agitating said metal surface for a time sufficient to cause the carbonaceous deposit to be removed therefrom.

The process results in effective carbonaceous deposit removal and when used on internal combustion engines, a drop in engine octane requirement. The aqueous bases of the present invention remove substantially more carbonaceous deposit than nonaqueous bases.

DETAILED DESCRIPTION OF THE INVENTION

The aqueous inorganic base of the present invention can be, for example, lithium, sodium, potassium, rubidium, and cesium, salts of the carbonate, bicarbonate, phosphate, biphosphate, sulfate, and bisulfate ions, and mixtures thereof. The aqueous organic base can be, for example, primary, secondary, or tertiary amines selected from aliphatic amines, olefinic amines, aromatic amines, and mixtures thereof. Preferably aqueous ethylenediamine will be used.

The present invention allows for removal of carbonaceous deposits from an internal combustion engine without requiring any substantial disassembly of the engine. The only necessary disassembly is removal of the engine's spark plugs, in the case of a spark-ignited internal combustion engine or the glow plugs in the case of a compression-ignited internal combustion engine, to allow for atomization of the aqueous base into the combustion chambers.

Utilization of the present invention reduces the octane requirement of a spark-ignited internal combustion engine; the reduction in octane requirement will vary depending on engine, age, etc.

After removing the spark plugs or glow plugs from the engine to be treated, the solution is atomized into the engine's combustion chambers through the plug ports. The engine is then allowed to stand for a time and at a temperature sufficient to effect carbonaceous deposit removal. Typically the engine will be allowed to stand for at least about 10 minutes, preferably 10 minutes to 1 hour. The engine is then operated for a time sufficient to provide adequate agitation and to remove the carbonaceous deposit from the combustion chambers. Typically the engine is operated at least about 5 minutes to provide agitation, preferably 5 minutes to 30 minutes. Longer contact periods and agitation periods outside of the preferred range are contemplated and have no adverse effect on the invention.

When removing carbonaceous deposits from the surface of metals, the metal surface to be treated is contacted with the aqueous base and allowed to soak for a time and at a temperature sufficient to effect carbonaceous deposit removal. Typically this soak period will be at least about 10 minutes, preferably 10 minutes to 1 hour. The metal surface is then agitated by any suitable means to allow any remaining carbon to de-adhere from the metal surface. Typically, the metal surface is agitated for at least about 5 minutes, preferably 5 minutes to 30 minutes. Longer contact periods and agitation periods outside of the preferred range are contemplated and have no adverse effect on the invention.

The aqueous organic or inorganic bases of the present invention are prepared simply by mixing water with the desired base. The solutions of the present invention range from about 0.01 molar to about 2 molar and are contacted with the metal surface to be treated at a temperature above about 0° C., preferably between about 0° and about 100° C., most preferably between about 50° and about 70° C.

The following examples, though not limiting, illustrate the invention.

EXAMPLE 1

The following example demonstrates that substantial quantities of combustion chamber deposit can be extracted into aqueous solutions of bases.

A representative sample of combustion chamber deposit was obtained by scraping the piston crowns and cylinder head of a six cylinder GM engine which had been run for 300 hours on an experimental premium grade gasoline and an experimental multigrade lubricant. One gram of this material was added to 30mL of water. After thirty minutes of stirring, the material did not dissolve to any measurable extent. One gram of the same deposit was then added to 30mL of water containing either NaOH (1 molar concentration), $Na_2CO_3$ (0.4 molar concentration), or ethylenediamine (0.66 molar concentration). In each of these cases a substantial quantity of solid dissolved or extracted into the aqueous basic solution, which took on a deep brown color after 2 minutes of stirring. After 30 minutes of continued stirring, the remaining unextracted solids were isolated via filtration in the case of $Na_2CO_3$ and NaOH or centrifugation in the case of ethylenediamine. The solids were dried in air and reweighed to determine the mass percent extracted into solution. 50%, 32%, and 38% of the solids were extracted into the aqueous NaOH, $Na_2CO_3$, and ethylenediamine solutions respectively.

EXAMPLE 2

This example shows treatment with aqueous ethylenediamine effectively extracts and delaminates combustion chamber deposits from a steel surface.

A plug containing two removable steel disks was inserted into the cylinder head of a 1 cylinder Cooperative Fuels Research engine. The two disks were positioned flush with the cylinder head surface, i.e., so that their surfaces would be representative of the the cylinder head. The engine was then started and run on Exxon Supreme fuel at 900 rpm with a compression ratio of 8.5:1 for 30 minutes. The engine was stopped and the plug was removed. The lower surface of the plug containing the two disks was uniformly covered with a dark brown layer of combustion deposit. Both disks were removed from the plug and weighed, showing about 4 mg of deposit had formed on each disk. One disk was immersed on a hotplate in a 70° C. solution containing 40 g of $H_2O$ and 2 g of ethylenediamine for 30 minutes. Some deposit extracted into the aqueous phase as indicated by the development of a yellow color in the solution. The remaining solid flaked off the disk readily when the disk was agitated gently by tapping with a glass rod. Microscopic examination of the disk showed that the treatment removed even the deposits lodged in the microscopic machining grooves of the disk. The remaining disk was sequentially treated with water, toluene, and hexane. None of these treatments was effective in removing substantial fractions of the deposit. No color was observed in the solution indicating that $<1$ wt% of carbonaceous deposit had been extracted. It was possible to remove the deposits with a steel brush and soapy water. However, microscopic examination showed deposits persisted in the machining grooves of the disk.

EXAMPLE 3

This example demonstrates that a treatment of combustion chamber deposits with aqueous ethylenediamine can reduce the octane requirement of an engine which has experienced substantial octane requirement increase.

Two matched Chevrolet 6-cylinder engines with initially clean combustion chambers were operated under identical conditions of rpm and load for 155 hours on an experimental premium grade gasoline. A rating .test showed the octane requirement of engines A and B had increased by 4.8 and 5.1 octane units, respectively, vs. The start of the test. Both engines were then stopped and allowed to cool to 35° C. The spark plugs in engine B were then removed. 4 grams of a 2 wt% solution of ethylenediamine in water were atomized into each of the six combustion chambers through their respective spark plug ports. The spark plugs were replaced and the engines were allowed to stand an additional 11 hours without operation. Both engines were restarted and run for 10 hours at the previous conditions before another series of octane requirement tests was performed. The engine treated with ethylenediamine solution showed a four unit drop in octane requirement vs. the measurement made just prior to the ethylenediamine treatment. The untreated engine showed no change in octane requirement vs. the last measurement.

EXAMPLE 4

The following example demonstrates that aqueous bases are more effective in removing carbonaceous deposits than nonaqueous bases followed by water.

A sample of deposits scraped from the combustion chamber surfaces of a General Motors 6-cylinder engine operated for 200 hours on unleaded premium gasoline was ground and sieved. The sieved fraction-containing particles between 149 and 177 microns was used in the following test:

At room temperature 1.00 gram of the deposit was combined with a solution containing 0.251 grams of ethylenediamine and 0.7 grams of diethylether. The mixture was allowed to stand in air for 15 minutes, during which period the diethylether evaporated. The dry powder was then extracted with five 2 mL aliquots of water at room temperature and then dried in air. Subsequent weighing of the dry powder showed 10.2% of its mass had been extracted into the water.

At room temperature, 1.00 grams of fresh, untreated deposit was extracted with a solution containing 0.12 grams of ethylenediamine in 2.88 grams of water. The extracted solid was dried in air at room temperature. Subsequent weighing of the solid showed 30.2% of the original solid had been extracted into the aqueous ethylenediamine water solution.

The results show a dramatic increase in the amount of carbonaceous deposit extracted when aqueous bases are used as compared with nonaqueous bases followed by water.

We claim:

1. A process for removing carbonaceous deposits from a metal surface comprising the steps of:

(a) contacting the metal surface with an aqueous base selected from the group consisting of lithium, sodium, potassium, rubidium and esium salts of carbonate, bicarbonate, phosphate, biphospahte, sulfate, and bisulfate ions nd mixtures thereof, and primary, secondary and tetrtiary aliphatic, aromatic, and olefinic amines and mixtures thereof;

(b) soaking said metal surface in said base at a temperature of about 0° C. to about 100° C. and or a time sufficient to effect carbonaceous deposit removal;

(c) agitating said metal surface at the temperature in step (b) for a time sufficient to cause the carbonaceous deposit to be removed therefrom.

2. A process according to claim 1 wherein said soaking step (b) is carried out for at least about 10 minutes.

3. A process according to claim 1 wherein said agitation step (c) is carried out for at least about 5 minutes.

4. A process for removing carbonaceous deposits from an internal combustion engine comprising the steps of:

(a) contacting the engine surface with an aqueous base selected from the group consisting of lithium, sodium, potassium, rubidium, and cesium salts of carbonate, bicarbonate, phosphate, biphospahte, sulphate, and bisulfate ions and mixtures thereof, and primary, secondary, and tertiary aliphatic, aromatic, and olefinic amines and mixtures thereof;

(b) soaking said metal surface in said base at a temperature of about 0° C. to about 100° C. and for a time sufficient to effect carbonaceous deposit removal;

(c) agitating said metal surface for a time sufficient to cause the carbonaceous deposit to be removed therefrom.

5. A process according to claim 4 wherein when said surface is a spark-ignited or compression-ignited internal combustion engine, said contacting step (a) is carried out by atomizing said aqueous base into the spark plug ports of said internal combustion engine or into the glow plug pots of said compression-ignited internal combustion engine, said soaking step (b) is carried out for at least about 10 minutes at a temperature of about 0° C. to about 100° C. and said agitation step (c) is carried out by operating said spark-ignited or compression-ignited internal combustion engine for at least about 5 minutes.

6. The process according to claim 1 wherein said primary aqueous aliphatic amine is aqueous ethylenediamine.

7. The process of claim 1 wherein said aqueous lithium, sodium, potassium, rubidium, and cesium, salts of carbonate, bicarbonate, sulfate, phosphate bisulfate, and biphosphate ions, and mixtures thereof.

8. The method of claim 1 wherein said aqueous base is aqueous sodium carbonate.

9. A process according to claim 1 wherein said aqueous bases are about 0.01 to about 2molar.

* * * * *